US009286824B2

(12) United States Patent
Ryu et al.

(10) Patent No.: US 9,286,824 B2
(45) Date of Patent: Mar. 15, 2016

(54) DISPLAY APPARATUS AND CONTROL METHOD THEREOF

(71) Applicant: Samsung Electronics Co., Ltd., Suwon-si, Gyeonggi-do (KR)

(72) Inventors: Hyun-jeong Ryu, Changwon-si (KR); Hong-ju Na, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 188 days.

(21) Appl. No.: 13/964,449

(22) Filed: Aug. 12, 2013

(65) Prior Publication Data

US 2014/0104305 A1 Apr. 17, 2014

(30) Foreign Application Priority Data

Oct. 16, 2012 (KR) ..... 10-2012-0114942

(51) Int. Cl.

| | |
|---|---|
| ***G09G 3/30*** | (2006.01) |
| ***G09G 5/02*** | (2006.01) |
| ***G09G 3/32*** | (2006.01) |

(52) U.S. Cl.

CPC ..... *G09G 3/32* (2013.01); *G09G 3/3208* (2013.01); *G09G 2320/0271* (2013.01); *G09G 2330/021* (2013.01); *G09G 2360/16* (2013.01)

(58) Field of Classification Search

None

See application file for complete search history.

(56) References Cited

U.S. PATENT DOCUMENTS

| | | | | |
|---|---|---|---|---|
| 4,489,349 | A * | 12/1984 | Okada | H04N 5/20 348/674 |
| 7,333,080 | B2 | 2/2008 | Miller et al. | |
| 2006/0022899 | A1 | 2/2006 | Johnson | |
| 2007/0176861 | A1 | 8/2007 | Tada et al. | |
| 2010/0328359 | A1 * | 12/2010 | Inoue et al. | 345/690 |
| 2011/0115832 | A1 | 5/2011 | Lee et al. | |
| 2012/0256936 | A1 | 10/2012 | Lee et al. | |
| 2013/0201223 | A1 * | 8/2013 | Li et al. | 345/690 |

FOREIGN PATENT DOCUMENTS

| | | |
|---|---|---|
| EP | 1895496 | 3/2008 |
| EP | 2151814 | 2/2010 |
| JP | 11-311965 | 11/1999 |

OTHER PUBLICATIONS

Extended European Search Report dated Jan. 21, 2014 from European Patent Application No. 13180835.4, 11 pages.

European Decision to Grant dated Jul. 21, 2015 from European Patent Application No. 13180835.4, 31 pages.

* cited by examiner

*Primary Examiner* — Yingchun He

(74) *Attorney, Agent, or Firm* — Staas & Halsey LLP

(57) ABSTRACT

A display apparatus includes a display unit which includes a plurality of pixels having an organic light emitting diode (OLED), a power supply which supplies power to the display unit, an image processor which processes an input image to display an image on the display unit, and a controller which determines whether an average picture level (APL) of the input image is a predetermined value or more. Based on the APL value, the controller controls the image processor to compensate for a gray scale of the input image to thereby increase a brightness of the input image, and controls the power supply to reduce the power supply corresponding to the brightness increased as a result of the compensated gray scale.

19 Claims, 5 Drawing Sheets

DISPLAY APPARATUS AND CONTROL METHOD THEREOF

CROSS-REFERENCE TO RELATED APPLICATIONS

This application claims priority from Korean Patent Application No. 10-2012-0114942, filed on Oct. 16, 2012 in the Korean Intellectual Property Office, the disclosure of which is incorporated herein by reference.

BACKGROUND

1. Field

Apparatuses and methods related to the exemplary embodiments disclosed herein pertain to a display apparatus and a control method thereof, and more particularly, to a display apparatus and a control method thereof which consumes less power without loss of brightness with respect to an image displayed by the display apparatus employing an organic light emitting diode.

2. Description of the Related Art

Organic light emitting diode (OLED) displays include an organic layer as a light emitting material provided between an anode with holes and a cathode with electrons. The OLED emits light by itself through re-combination of holes and electrons injected to the organic layer, and has a high brightness and a low driving voltage and can be made having an ultra-thin layer.

A conventional OLED display apparatus supplies a consistent or constant driving voltage to OLED pixels regardless of a change in gray scale, brightness, etc. in an input image. If an entire brightness of an image to be displayed is dark, a surplus voltage is generated as each OLED pixel requires a low current but has a consistent or constant driving voltage. The surplus voltage is consumed as heat, and wastes power consumption.

If an average picture level of an input image signal rises, power consumption of the OLED display apparatus increases proportionally. If the average picture level reaches a predetermined level or more, the OLED display apparatus maintains a consistent or constant power consumption level rather than consuming more power in proportion to the average picture level.

SUMMARY

Additional aspects and/or advantages will be set forth in part in the description which follows and, in part, will be apparent from the description, or may be learned by practice of the invention.

Accordingly, one or more exemplary embodiments provide a display apparatus and a control method thereof which consumes less power by using light emitting and power consumption characteristics of the OLED.

The foregoing and/or other aspects may be achieved by providing a display apparatus including: a display unit which includes a plurality of pixels having an organic light emitting diode (OLED); a power supply which supplies power to the display unit; an image processor which processes an input image to display an image on the display unit; and a controller which determines whether an average picture level (APL) of the input image is a predetermined value or more, controls the image processor to compensate for a gray scale of the input image to thereby increase a brightness of the input image, and controls the power supply to reduce power supply corresponding to the brightness increased as a result of the compensated gray scale.

Also, the controller may determine a duty value corresponding to the compensated gray scale, and reduces the power supply based on the determined duty value.

Also, the display apparatus may further include a storage unit which stores therein a compensation coefficient for compensating for the gray scale of the input image and a duty value corresponding to the compensation coefficient, as a lookup table.

Also, the compensation coefficient may be provided so that a maximum gray scale of the input image corresponds to a preset predetermined gray scale value.

Also, the duty value may be provided so that a brightness of an image displayed on the display unit is the same as a brightness of the input image before the compensation for the gray scale.

Also, the image processor may further include a brightness compensating unit, and the brightness compensating unit includes an APL extractor which extracts an APL of the input image; a histogram calculator which calculates a histogram of the input image; a maximum gray scale extractor which extracts a maximum gray scale of the calculated histogram; and a compensation processor which compensates for a gray scale of the input image based on a compensation coefficient that is set so that the extracted maximum gray scale corresponds to a predetermined gray scale value.

The foregoing and/or other aspects may be achieved by providing a control method of a display apparatus including: determining whether an APL of an input image is a predetermined value or more; compensating for a gray scale of the input image to increase the brightness of the input image; and reducing power supply corresponding to the brightness increased as a result of the compensated gray scale.

Also, the reducing the power supply may include determining a duty value corresponding to the compensated gray scale and reducing the power supply base on the determined duty value.

Also, the compensating for the gray scale of the input image may include referring to a compensation coefficient for compensating for the gray sale of the input image that is stored in advance as a lookup table in a storage unit; and the reducing the power supply includes referring to a duty value corresponding to the compensation coefficient that is stored in advance as a lookup table in the storage unit.

Also, the compensation coefficient may be provided so that a maximum gray scale of the input image corresponds to a preset predetermined gray scale value.

Also, the duty value may be provided so that a brightness of an image displayed on the display unit is the same as a brightness of an input image before the compensation for the gray scale.

Also, the compensating for the gray scale of the input image may further include extracting an APL of the input image; calculating a histogram of the input image; extracting a maximum gray scale of the calculated histogram; and compensating for the gray scale of the input image based on the compensation coefficient which is set so that the extracted maximum gray scale corresponds to a predetermined gray scale value.

The foregoing and/or other aspects may be achieved by providing a display apparatus including: a organic light emitting diode (OLED) display including a plurality of pixels, and a controller to control an image processor to adjust a gray scale value of an input image based upon an average value of a brightness level of an input image signal displayed by each of the plurality of pixels. The controller may further adjust an amount of power supplied to the display based upon the average value of the brightness level of the input image signal displayed in each of the plurality of pixels. If the average value of the brightness level of the input image signal is greater than or equal to a predetermined value, the controller may increase the gray scale value of the input image and decrease the amount of power supplied to the display, such that a resulting brightness of the image displayed on the display is substantially identical to the brightness of the input image signal before adjusting the gray scale value of the input image.

BRIEF DESCRIPTION OF THE DRAWINGS

The above and/or other aspects will become apparent and more readily appreciated from the following description of the exemplary embodiments, taken in conjunction with the accompanying drawings, in which.

DETAILED DESCRIPTION

Figure 1:
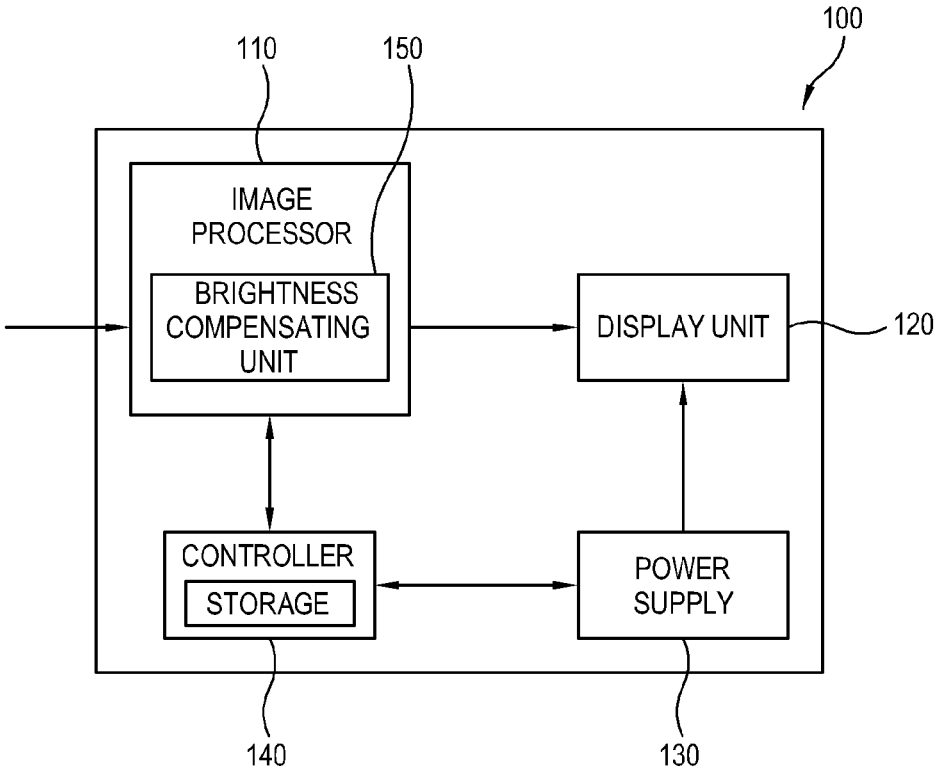
FIG. 1 is a block diagram of a display apparatus according to an embodiment.

Below, exemplary embodiments will be described in detail with reference to accompanying drawings so as to be easily realized by a person having ordinary knowledge in the art. The exemplary embodiments may be embodied in various forms without being limited to the exemplary embodiments set forth herein. Descriptions of well-known parts are omitted for clarity, and like reference numerals refer to like elements throughout.

Figure 2:
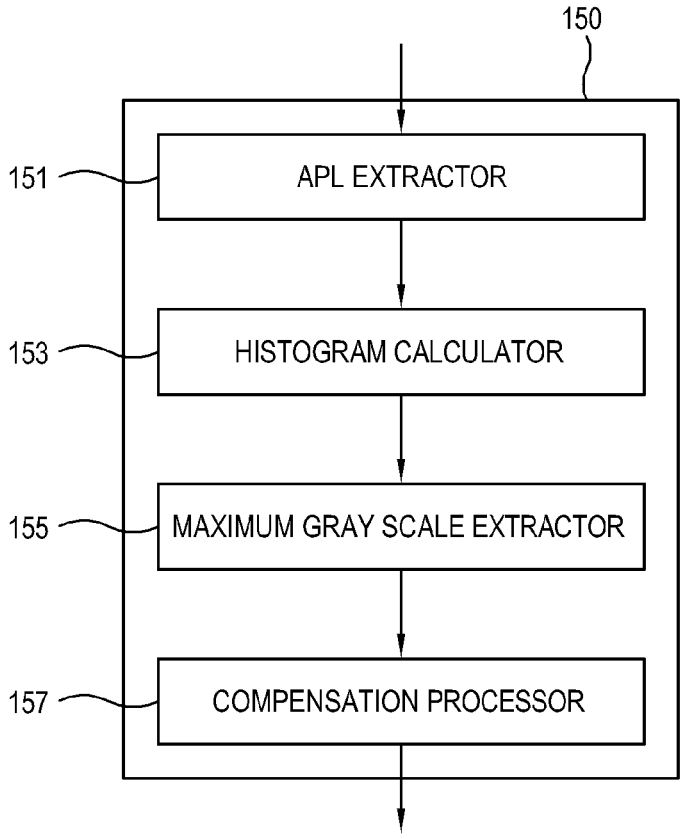
FIG. 2 is a block diagram of a brightness compensating unit according to the embodiment.

FIG. 1 is a block diagram of a display apparatus 100 according to an embodiment. FIG. 2 is a block diagram of a brightness compensating unit.

As shown in FIG. 1, the display apparatus 100 may include a signal input unit (not shown) which receives at least one image signal, an image processor 110 which processes an image signal transmitted through the signal input unit, a display unit 120 which displays an image thereon based on an image signal processed by the image processor 110, a power supply 130 which supplies power to the display unit 120, a storage unit 160 which stores therein data and/or information, and a controller 140 which controls overall elements of the display apparatus 100.

The signal input unit transmits the received image signal to the image processor 110, and varies depending on a standard of a received signal or embodiment type of an image supply source and the display apparatus 100. For example, the signal input unit may receive signals and/or data according to standards such as high definition multimedia interface (HDMI), universal serial bus (USB), Component, S-video, digital video interface (DVI), etc., and includes a plurality of connection terminals (not shown) corresponding to the foregoing standards.

The signal input unit receives a broadcasting signal input an image signal from a broadcasting station, satellite, etc., and may include a tuner to tune a channel of a received broadcasting signal.

The image processor 110 processes an image signal transmitted by the signal input unit, according to various preset image processing operations. The image processor 110 outputs the processed image signal to the display unit 120, on which an image may be displayed on the basis of the processed image signal.

The image processing operation of the image processor 110 may include, but is not limited to, a de-multiplexing operation for dividing a predetermined signal into a predetermined number of signals, a decoding operation corresponding to an image format of an image signal, a de-interlacing operation for converting an interlace image signal into a progressive image signal, a scaling operation for adjusting an image signal into a preset resolution, a noise reduction operation for improving an image quality, a detail enhancement operation, a frame refresh rate conversion, etc.

The image processor 110 may include a brightness compensating unit 150 which increases a brightness of an input image signal as will be described later.

The display unit 120 displays an image thereon based on an image signal output by the image processor 110, and is implemented as an organic light emitting diode (OLED) display.

A display panel (not shown) of the display unit 120 may include a plurality of pixels arranged in a matrix consisting of rows and columns. The plurality of pixels may include an OLED and a cell driver which independently drives the OLED.

The power supply 130 supplies power to the display panel of the display unit 120 according to a control signal of the controller 140 which will be described later. The power supply 130 in FIG. 1 is separately provided from the display unit 120, but is not limited thereto. Alternatively, the power supply 130 according to the embodiment may be included in the display unit 120.

The storage unit 160 stores therein a compensation coefficient for compensating for a gray scale of an input image which will be described later, and a duty value corresponding to the compensation coefficient, as a lookup table. The storage unit may be accessed by the controller 140 and the data stored in the storage unit may be read, written, amended, deleted, and/or updated by the controller 140. The storage unit 160 may be installed in the controller 140 as shown in FIG. 1 for example, or may be provided separately, for example as an external memory. The storage 160, which may store one or more of the lookup tables disclosed herein, may be realized for example, by a non-volatile memory device such as a read only memory (ROM), a random access memory (RAM), a programmable read only memory (PROM), an erasable programmable read only memory (EPROM), or a flash memory, a volatile memory device such as a random access memory (RAM), or a storage medium such as a hard disk or optical disk. However, the present invention is not limited thereto.

The controller 140 controls the image processor 110 and/or the brightness compensating unit 150 to compensate for a gray scale of an input image, and controls the power supply 130 to reduce the power supply corresponding to the brightness increased as a result of the compensated gray scale. The controller may use one or more processors to perform its respective functions.

The brightness compensating unit 150 includes an average picture level (APL) extractor 151 which extracts an APL of an input image, a histogram calculator 153, a maximum gray scale extractor 155 which extracts a maximum gray scale from the calculated histogram, and a compensation processor 157 which compensates for a gray scale of an input image so that the extracted maximum gray scale corresponds to a predetermined gray scale value.

As shown in FIG. 1, the brightness compensating unit 150 may be included in the image processor 110 or may be separately provided from the image processor 110.

The APL extractor 151 extracts an APL of an input image signal by frame. That is, for each frame of the input image signal, an APL may be extracted by the APL extractor 151. However, the disclosure is not limited thereto. For example, the APL extractor 151 may extract an APL according to a set frequency (e.g., extracting an APL of a frame for every "X" number of frames of the input image signal, for example, extracting an APL of a frame every other frame). The APL refers to an average value of a brightness level of an input image signal to be displayed in each of a plurality of pixels included in the display unit 120.

The controller 140 determines whether the APL extracted from the input image signal is a predetermined value or more. If it is determined that the APL is less than the predetermined value, the controller 140 outputs the image signal to the display unit 120 rather than compensating for the gray scale of the input image signal. That is, if the APL is less than a predetermined threshold value, the controller 140 outputs the image signal to the display unit 120 without compensating for the gray scale of the input image signal. If it is determined that the APL is the predetermined value or more, the controller 140 controls the histogram calculator 153 to calculate a histogram of the input image. That is, if the APL is equal to or greater than a predetermined threshold value, the controller 140 may perform a compensation operation on the input image signal.

Figure 3:
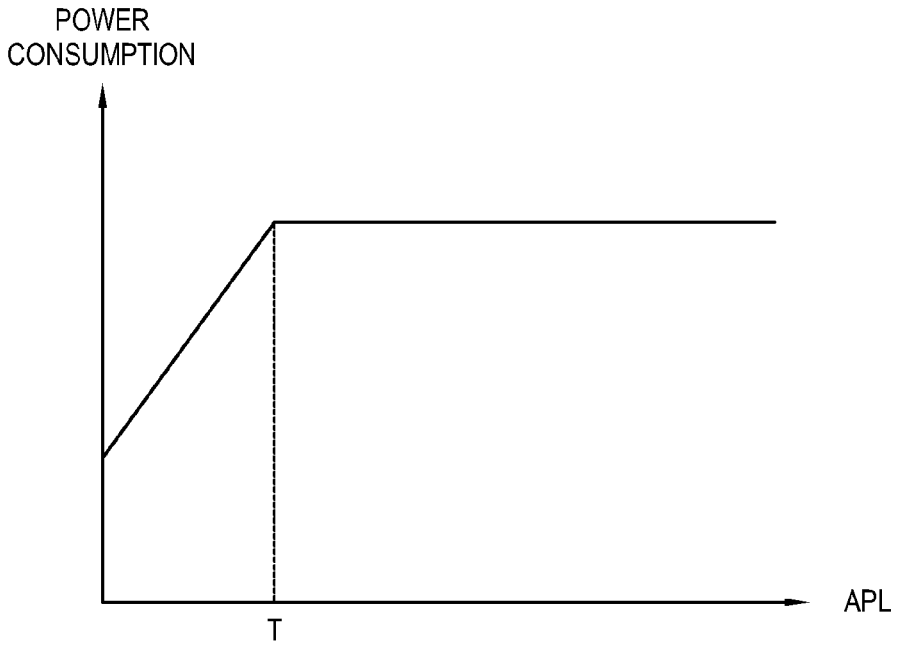
FIG. 3 illustrates a correlation between an average picture level and power consumption of an OLED display apparatus.

FIG. 3 illustrates a correlation between the APL of the OLED display apparatus and power consumption. Due to the nature of the OLED display apparatus, if the APL is low, the OLED display apparatus consumes more power in proportion to the APL. That is, for an APL between a first value and a threshold value T, as the APL increases, power consumption increases in a proportionate manner. If the APL is a predetermined value or more, the OLED display apparatus consume power consistently or at a substantially constant rate rather than consuming more power in proportion to the APL. That is, for an APL equal to or greater than the threshold value T, as the APL increases, power consumption remains at a relatively or substantially constant level.

As shown in FIG. 3, the predetermined value corresponds to an APL having a threshold value T. In proportion to the increase in the APL, the power consumption increases, and if the APL increases further and reaches the predetermined value, the power consumption does not increase in proportion to the APL.

Figure 4:
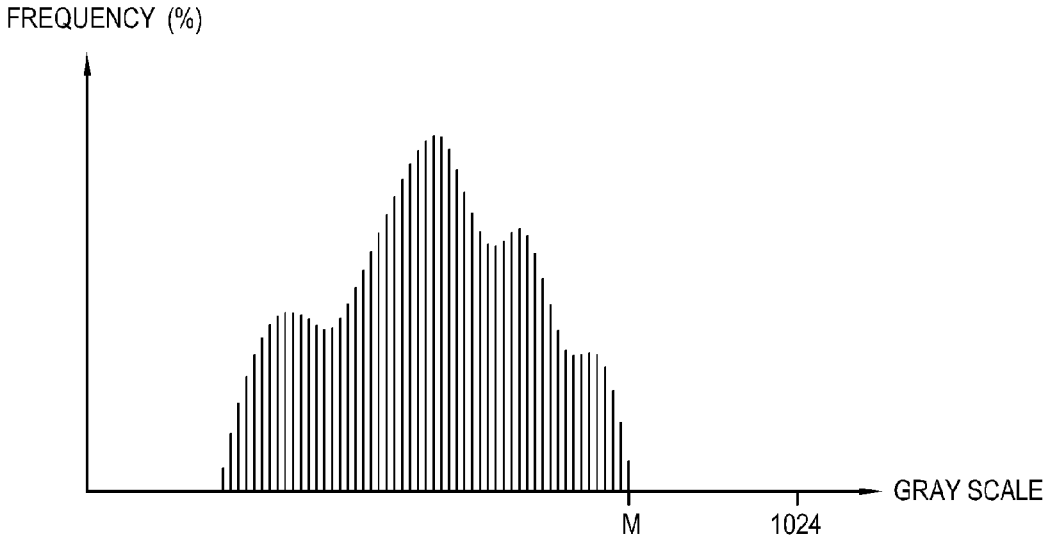
FIG. 4 illustrates an example of a histogram of an input image signal according to the embodiment.

FIG. 4 illustrates an example of a histogram with respect to an input image signal of a single frame that is calculated by the histogram calculator 153.

A horizontal axis of the histogram in FIG. 4 refers to a gray scale value, and e.g., a gray scale value of 1024 when the input image signal is based on 10 bits. However, the disclosure is not so limited and the gray scale value may correspond to another value according to the number of shades of gray and corresponding bits which are desired to be represented in the image signal. A vertical axis of the histogram refers to the frequency of a gray scale value corresponding to each of a plurality of pixels included in the display panel. For example, 5% frequency of 300 gray scale means that the number of pixels representing 300 gray scale is 5% of the total number of pixels. Here, the total number of pixels may refer to all of the pixels in the frame. Alternatively, a subset or sample of all of the pixels in the frame may be used instead of all of the pixels in the frame. Thus, the histogram may be developed based on a representative portion of all of the pixels in the frame and a maximum gray scale value M (described below) may be extracted from the representative portion of all of the pixels in the frame.

The maximum gray scale extractor 155 extracts a maximum gray scale from the histogram calculated by the histogram calculator 153. For example, the maximum gray scale extractor 155 extracts a maximum gray scale M of the histogram shown in FIG. 4.

The controller 140 determines whether the extracted maximum gray scale is a predetermined gray scale value or more. For example, referring to FIG. 4, if a predetermined gray scale value is set as 1024, the controller 140 determines whether the extracted maximum gray scale M is 1024 or more.

The predetermined gray scale value may be set as a peak gray scale of an input image, e.g., as 1024 gray scale when the input image signal is based on 10 bits, but the disclosure is not limited thereto. Alternatively, the predetermined gray scale value may be set as a lower gray scale than the peak gray scale, e.g., 512 or 1000.

If the extracted maximum gray scale M is smaller than 1024 gray scale when 1024 gray scale is set as the predetermined gray scale value, the controller 140 controls the compensation processor 157 to compensate for the gray scale of the input image signal.

The storage unit stores in advance therein a compensation coefficient as a lookup table to compensate for the gray scale of the input image signal. The compensation coefficient is a preset predetermined gray scale value, e.g. the compensation coefficient may be a value calculated by dividing the preset peak gray scale (e.g., 1024 gray scale) by the extracted maximum gray scale M. That is, the compensation coefficient refers to a compensation gain that may increase the gray scale value of the maximum gray scale M up to the preset peak gray scale (e.g., 1024 gray scale) by multiplying the maximum gray scale M by the compensation coefficient. For example, if the maximum gray scale M is 800 gray scale and the preset peak gray scale is 1024 gray scale, then the compensation coefficient may be calculated by dividing 1024 by 800 which is about 1.28 and this value may be referred to as a compensation gain.

The controller 140 determines a compensation coefficient corresponding to the maximum gray scale of the input image by referring to the lookup table stored in the storage unit.

Based on the determined compensation coefficient, the compensation processor 157 compensates for a gray scale of a plurality of pixels of the input image signal, and outputs to the display unit 120 image data whose gray scale has been increased as a whole. For example, according to the above-described example, the compensation processor 157 may compensate for a gray scale of a plurality of pixels of the input image signal by applying the compensation gain to the plurality of pixels (e.g., by increasing the image data gray scale values for each of the pixels by about 1.28 times).

Accordingly, the image data output to the display unit 120 has a higher brightness than the brightness of the input image signal.

The storage unit stores in advance therein a duty value as a lookup table corresponding to the compensation coefficient to compensate for the gray scale of the input image signal. The duty value refers to a power duty value which is used to display the image data with the increased brightness by the compensation for the gray scale, in the same brightness as the input image, i.e., that reduces the brightness of the image data. The duty value corresponds to each compensation coefficient. The higher the compensation coefficient is, the lower the duty value for reducing the brightness is.

The controller 140 determines a duty value corresponding to the compensation coefficient of the input image by referring to the lookup table stored in the storage unit, and controls the power supply 130 to supply power corresponding to the determined duty value, i.e. with a lower duty value.

The power supply 130 may include a duty value controller (not shown), which supplies power with the determined duty value corresponding to a control signal of the controller 140. Otherwise, a pulse width modulation (PWM) generator (not shown) may be additionally provided to generate a PWM signal corresponding to the duty value determined by the controller 140. The power supply 130 may receive the PWM signal and accordingly adjust an output voltage level.

Accordingly, the duty value may be reduced corresponding to the brightness that is increased as a result of the compensation for the gray scale of the image to display the input image in the same brightness, and power consumption may be reduced by the reduced duty value.

Figure 5:
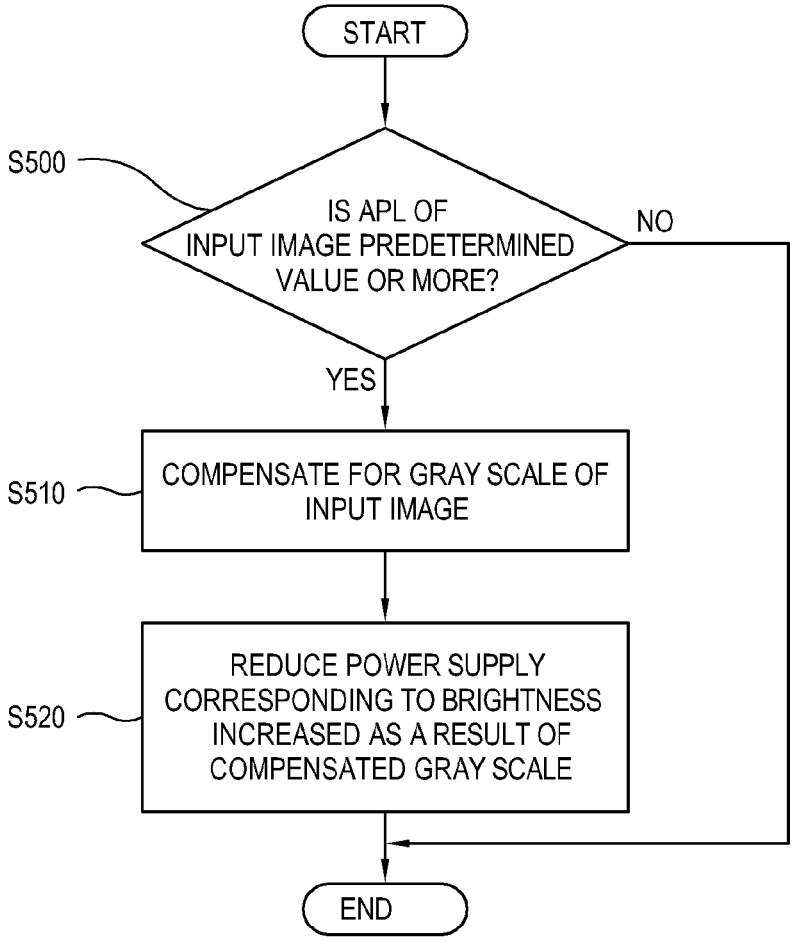
FIG. 5 is a flowchart showing a control method of the display apparatus according to the embodiment.

Hereinafter, a control method of the display apparatus according to the embodiment will be described with reference to FIG. 5.

As shown therein, the controller 140 controls the image processor 110 and/or the brightness compensating unit 150 to extract an APL for a frame of the input image signal. The controller 140 determines whether the extracted APL is a predetermined value or more (S500). If it is determined that the extracted APL is less than the predetermined value, the controller 140 outputs the image signal to the display unit 120 rather than compensating for the gray scale of the input image signal. If it is determined that the extracted APL is equal to the predetermined value or more, the controller 140 compensates for the gray scale of the input image to increase the brightness of the input image (S510).

The operation of compensating for the gray scale of the input image may include an operation of extracting the APL of the input image, an operation of calculating the histogram of the input image, an operation of extracting the maximum gray scale of the calculated histogram, and an operation of compensating for the gray scale of the input image based on the compensation coefficient which is set so that the extracted maximum gray scale corresponds to the predetermined gray scale value.

The compensation gray scale may be stored in advance as a lookup table in the storage unit and may be provided so that the maximum gray scale of the input image corresponds to the preset predetermined gray scale value.

The controller 140 reduces the power supply corresponding to the brightness that has been increased as a result of the compensated gray scale (S520). That is, the controller 140 determines the duty value corresponding to the compensated gray scale, and reduces the power supply based on the determined duty value.

The duty value may be stored in advance as a lookup table in the storage unit, and may be provided so that the brightness of the image displayed on the display unit is the same as a brightness of the input image before the compensation for the gray scale.

As described above, a display apparatus and a control method thereof according to an embodiment may consume less power by using light emitting and power consumption characteristics of the OLED. In one example, an average picture level (APL) of an input image is compared with a predetermined threshold value, and an image processor is controlled to compensate for a gray scale of the input image to thereby increase a brightness of the input image based on a result of the comparison. The average picture level may refer to an average value of a brightness level of an input image signal. However, in alternative embodiments other statistical measures may be implemented. For example, a median picture level may refer to a median value of a brightness level of an input image signal, and the median picture level may be compared with another predetermined threshold value to determine whether gray scale compensation should be performed to increase a brightness of the input image.

As mentioned above, the APL may refer to an average value of a brightness level of an input image signal, which may be calculated based upon the brightness level of each of the plurality of pixels displayed by the display. Alternatively, the average value of a brightness level of an input image signal may be calculated based upon the brightness level of a representative portion of pixels displayed by the display, i.e., a subset of the total number of pixels of the display.

The display apparatus and control methods according to the above-described example embodiments may use one or more processors, which may include a microprocessor, central processing unit (CPU), digital signal processor (DSP), or application-specific integrated circuit (ASIC), as well as portions or combinations of these and other processing devices.

The terms "module", and "unit," as used herein, may refer to, but are not limited to, a software or hardware component or device, such as a Field Programmable Gate Array (FPGA) or Application Specific Integrated Circuit (ASIC), which performs certain tasks. A module or unit may be configured to reside on an addressable storage medium and configured to execute on one or more processors. Thus, a module or unit may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables. The functionality provided for in the components and modules/units may be combined into fewer components and modules/units or further separated into additional components and modules.

Each block of the flowchart illustrations may represent a unit, module, segment, or portion of code, which comprises one or more executable instructions for implementing the specified logical function(s). It should also be noted that in some alternative implementations, the functions noted in the blocks may occur out of the order. For example, two blocks shown in succession may in fact be executed substantially concurrently or the blocks may sometimes be executed in the reverse order, depending upon the functionality involved.

The apparatus and methods according to the above-described embodiments may be recorded in non-transitory computer-readable media including program instructions to implement various operations embodied by a computer. The media may also include, alone or in combination with the program instructions, data files, data structures, and the like. Examples of non-transitory computer-readable media include magnetic media such as hard disks, floppy disks, and magnetic tape; optical media such as CD ROM disks and DVDs; magneto-optical media such as optical discs; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa. In addition, a non-transitory computer-readable storage medium may be distributed among computer systems connected through a network and computer-readable codes or program instructions may be stored and executed in a decentralized manner. In addition, the computer-readable storage media may also be embodied in at least one application specific integrated circuit (ASIC) or Field Programmable Gate Array (FPGA).

Although a few exemplary embodiments have been shown and described, it will be appreciated by those skilled in the art that changes may be made to these exemplary embodiments without departing from the principles and spirit of the invention, the scope of which is defined in the appended claims and their equivalents.

What is claimed is:

1. A display apparatus comprising:

a display unit which comprises a plurality of pixels having an organic light emitting diode (OLED);

a power supply to supply power to the display unit;

an image processor to process an input image to display an image on the display unit; and a controller to determine whether an average picture level (APL) of the input image is greater than or equal to a predetermined value, wherein if the APL of the input image is greater than or equal to the predetermined value, the controller controls the image processor to compensate for a gray scale of the input image to thereby increase a brightness of the input image, and controls the power supply to reduce power supply corresponding to the brightness increased as a result of the compensated gray scale, and if the APL of the input image is less than the predetermined value, the controller controls the image processor to maintain the gray scale of the input image so that the brightness of the input image is unchanged.

2. The display apparatus according to claim 1, wherein the controller determines a duty value corresponding to the compensated gray scale, and reduces the power supply based on the determined duty value.

3. The display apparatus according to claim 1, further comprising hardware storage to store a compensation coefficient for compensating for the gray scale of the input image and to store a duty value corresponding to the compensation coefficient, using a lookup table.

4. The display apparatus according to claim 3, wherein the duty value is calculated so that a brightness of an image displayed on the display unit after compensation for the gray scale is the same as a brightness of the input image before the compensation for the gray scale.

5. The display apparatus according to claim 1, wherein the image processor further comprises a brightness compensating unit, wherein the brightness compensating unit comprises an APL extractor which extracts an APL of the input image, and compensation by the image processor is selectively preformed based on the extracted APL value.

6. The display apparatus according to claim 5, wherein if the extracted APL value is greater than or equal to the predetermined value the brightness compensating unit further comprises:

a histogram calculator to calculate a histogram of the input image;

a maximum gray scale extractor to extract a maximum gray scale of the calculated histogram; and a compensation processor to compensate for a gray scale of the input image based on a compensation coefficient that is set so that the extracted maximum gray scale corresponds to a predetermined gray scale value.

7. The display apparatus according to claim 1, wherein if the APL of the input image is less than the predetermined value, the controller controls the image processor to maintain the gray scale of the input image so that the brightness of the input image is unchanged, and controls the power supply to maintain power supply corresponding to the brightness of the input image.

8. A display apparatus comprising:

a display unit which comprises a plurality of pixels having an organic light emitting diode (OLED);

a power supply to supply power to the display unit;

an image processor to process an input image to display an image on the display unit;

a controller to determine whether an average picture level (APL) of the input image is greater than or equal to a predetermined value, to selectively control the image processor to compensate for a gray scale of the input image to thereby increase a brightness of the input image, and to control the power supply to reduce power supply corresponding to the brightness increased as a result of the compensated gray scale; and a hardware storage to store a compensation coefficient for compensating for the gray scale of the input image and to store a duty value corresponding to the compensation coefficient, using a lookup table, wherein the compensation coefficient is calculated so that a maximum gray scale of the input image corresponds to a preset predetermined gray scale value.

9. A control method of a display apparatus comprising:

determining whether an average picture level (APL) of an input image is greater than or equal to a predetermined value;

if the APL of the input image is greater than or equal to the predetermined value, compensating for a gray scale of the input image to increase a brightness of the input image and reducing power supply corresponding to the brightness increased as a result of the compensated gray scale; and if the APL of the input image is less than the predetermined value, maintaining the gray scale of the input image so that the brightness of the input image is unchanged.

10. The control method according to claim 9, wherein the reducing the power supply comprises determining a duty value corresponding to the compensated gray scale and reducing the power supply base on the determined duty value.

11. The control method according to claim 9, wherein the compensating for the gray scale of the input image comprises referring to a compensation coefficient for compensating for the gray scale of the input image that is stored in advance in a lookup table stored in a hardware storage.

12. The control method according to claim 11, wherein the reducing the power supply comprises referring to a duty value corresponding to the compensation coefficient that is stored in advance in the lookup table stored in the hardware storage.

13. The control method according to claim 12, wherein the duty value is calculated so that a brightness of an image displayed on a display unit after the compensation for the gray scale is the same as a brightness of an input image before the compensation for the gray scale.

14. The control method according to claim 9, wherein the compensating for the gray scale of the input image further comprises extracting an APL value of the input image and compensation of the input image is selectively performed based on the extracted APL value.

15. The control method according to claim 14, wherein if the extracted APL value is greater than or equal to the predetermined value the compensating for the gray scale of the input image further comprises:

calculating a histogram of the input image;

extracting a maximum gray scale of the calculated histogram; and compensating for the gray scale of the input image based on a compensation coefficient which is set so that the extracted maximum gray scale corresponds to a predetermined gray scale value.

16. A control method of a display apparatus comprising:

determining whether an average picture level (APL) of an input image is greater than or equal to a predetermined value;

compensating for a gray scale of the input image to increase a brightness of the input image; and reducing power supply corresponding to the brightness increased as a result of the compensated gray scale, wherein the compensating for the gray scale of the input image comprises referring to a compensation coefficient for compensating for the gray scale of the input image that is stored in advance in a lookup table stored in a hardware storage, and the compensation coefficient is calculated so that a maximum gray scale of the input image corresponds to a preset predetermined gray scale value.

17. A display apparatus comprising:

an organic light emitting diode (OLED) display including a plurality of pixels; and a controller to control an image processor to adjust a gray scale value of an input image based upon an average value of a brightness level of an input image signal displayed by each of the plurality of pixels, wherein if the average value of the brightness level of the input image is greater than or equal to a predetermined value, the controller controls the image processor to compensate for the gray scale of the input image to thereby increase the brightness level of the input image, and if the average value of the brightness level of the input image is less than the predetermined value, the controller controls the image processor to maintain the gray scale of the input image so that the brightness of the input image is unchanged.

18. The display apparatus of claim 17, wherein the controller further adjusts an amount of power supplied to the display based upon the average value of the brightness level of the input image signal displayed in each of the plurality of pixels.

19. The display apparatus of claim 18, wherein if the average value of the brightness level of the input image signal is greater than or equal to a predetermined value, the controller decreases the amount of power supplied to the display, such that a resulting brightness of the image displayed on the display is substantially identical to the brightness of the input image signal before adjusting the gray scale value of the input image.

* * * * *